US005833031A

United States Patent [19]

Liebetrau et al.

[11] Patent Number: 5,833,031

[45] Date of Patent: Nov. 10, 1998

[54] APPENDABLE ELEVATOR SYSTEM

[75] Inventors: Christoph Liebetrau, Menziken; Utz Richter, Ebikon, both of Switzerland

[73] Assignee: Inventio AG, Hergiswil, Switzerland

[21] Appl. No.: 643,786

[22] Filed: May 6, 1996

[30] Foreign Application Priority Data

Jun. 2, 1995 [CH] Switzerland ..... 01 622/95

[51] Int. Cl.[6] ..... A66B 9/00

[52] U.S. Cl. ..... 187/239; 187/404

[58] Field of Search ..... 187/404, 239, 187/413, 410; 182/141

[56] References Cited

U.S. PATENT DOCUMENTS 2,531,346 11/1950 Schuchent ..... 187/239
4,529,062 7/1985 Lampner ..... 187/404

FOREIGN PATENT DOCUMENTS 1274882 2/1962 France .
1506479 12/1969 Germany .
9302119 5/1993 Germany .

*Primary Examiner*—Kenneth Noland
*Attorney, Agent, or Firm*—William J. Clemens

[57] ABSTRACT

An appendable elevator for the transport of persons and goods can be attached to an outside surface (2) of a wall (16) of a building (1) and includes a self-driven car (5) which runs on a pair of vertically extending guide modules (10). The guide modules (10) are attached at lower ends to a foundation module (12) and at upper ends to a shaft head module (13) to form an inherently stiff and transportable frame. Counterweights (18) are mounted in the guide modules (10) and are attached to the car (5) by cables (19) which engage deflecting rollers (14) mounted on the shaft head module (13). Fastening modules (11) are attached to the guide modules (10) and telescopically mount shaft doors (22). Drive wheels (7), supporting wheels (8) and guide rollers (9) as well as wiring and control equipment are mounted in and on the car (5) to form a prefabricated elevator system which is attached by extending the fastening modules (11) into contact with the building (1).

16 Claims, 3 Drawing Sheets

APPENDABLE ELEVATOR SYSTEM

BACKGROUND OF THE INVENTION

The present invention relates generally to elevators for transporting persons and goods and, in particular, to an elevator which can be attached to an outside wall of an existing building.

Elevator installations built on the outside walls of buildings, in particular, are used for the purpose of modernizing existing buildings without elevators. For this purpose, the outside wall intended for the attachment of the elevator is provided with shaft doors and a shaft frame is erected on the outside wall. The installation of an elevator with guide rails for the car and a counterweight, buffers, a shaft position detector and so forth then takes place in the shaft frame itself. Thus the installation on an outside wall is similar to the installation of an elevation in a shaft in the interior of a building.

An elevator, which is carried and guided by two strong columns in which counterweights run without loading the building, is described in the German published specification DE 1 506 479. An "elastic drive shaft drive", which has toothed pinions at both sides to engage a roller chain embedded in a kink-resistant manner in the columns, is mounted on the car. Due to the special kind of drive, a car-arresting device should not be required. However, the use of this construction as a comfortable passenger elevator is restricted because the drive develops strong vibrations and noises and is therefore suitable only for lower speeds, which use is confirmed by the indication "for industrial and garage lifts" in the specification. Furthermore, it is not evident from the specification and the drawings how the car is carried and how the access from the car to the building and conversely is provided.

SUMMARY OF THE INVENTION

The present invention concerns an appendable elevator system for the transport of persons and goods, which is attached to a building wall and has self-driven elevator car which runs along two column-like guides and is connected with a counterweight. The appendable elevator comprises: a self-supporting and transportable frame having a pair of spaced apart guide modules attached at lower ends thereof to a foundation module and at upper ends thereof to shaft head module and having at least one fastening module attached to said guide modules and adapted to be attached to a surface of a wall of a building with said guide modules extending in a generally vertical direction; an elevator car mounted for travel along said guide modules; at least one counterweight mounted for movement in one of said guide modules; and at least one cable having one end attached to said car and an opposite end attached to said counterweight.

The present invention is therefore based upon the object of creating a modularly constructed and prefabricatable appendable elevator which can be manufactured at favorable cost, is equipped completely, can be installed in a short time, is usable for the middle range in respect of speed and conveying height and fulfills the safety demands of a passenger elevator.

The invention distinguishes itself inter alia by the appendable elevator having only a few parts and being capable of being transported to the building site prefabricated as a whole for small and medium conveying heights. By appropriate arrangement of the car and the supporting frame and guides, an optimum utilization of an available base area is achieved.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
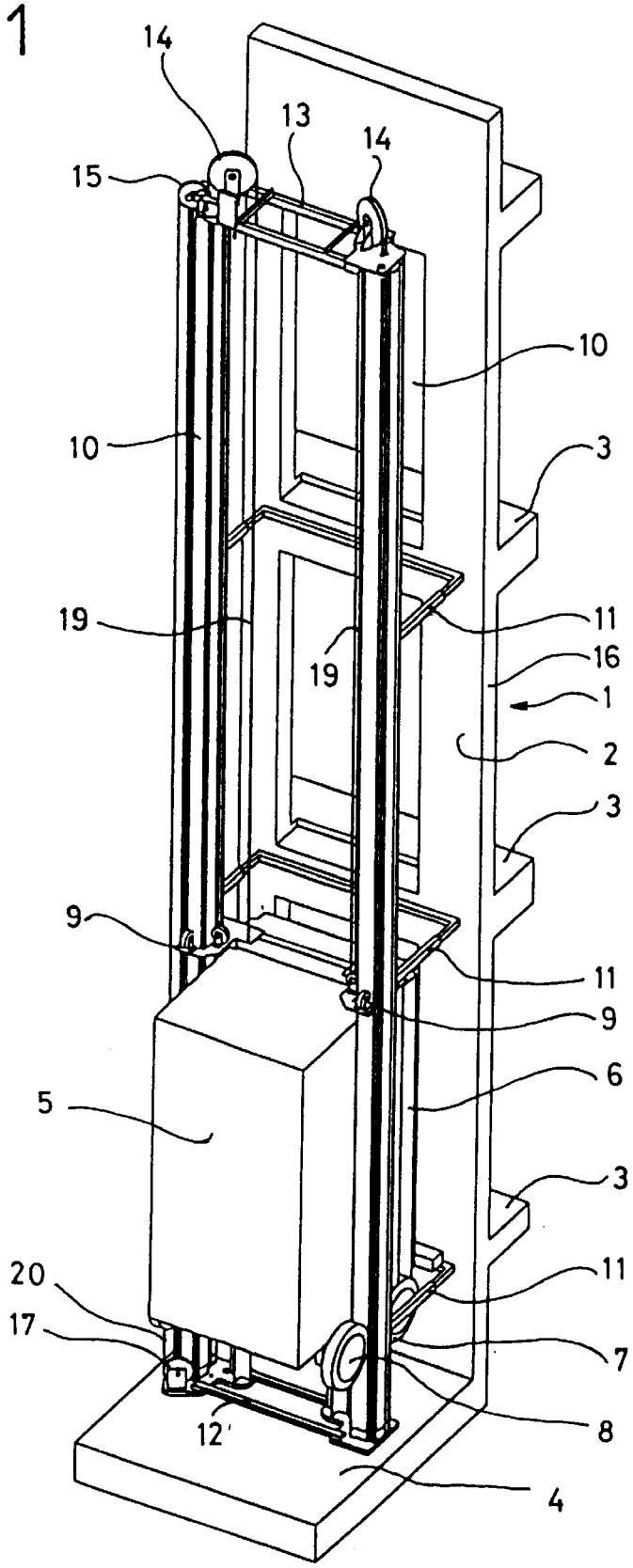
FIG. 1 is a schematic perspective view of an elevator mounted on an outer wall of a building in accordance with the present invention.

There is shown in the FIG. 1, an appendable elevator system attached to an outer surface 2 of an outside wall 16 of a building 1. Two vertically extending, generally hollow guide modules 10 are supported at opposite ends and fastened at the spacing of a track width on lateral ends of a foundation module 12 resting on a building base area 4. Upper ends of the guide modules 10 are closed off by a shaft head module 13 spanning the track width. Between the guide modules 10, there is positioned a car 5 which has a drive (not shown) mounted on an underside thereof. The drive drives a pair of drive wheels 7 mounted on opposite sides of the car 5, which wheels run along on first running surfaces of the guide modules 10. The drive wheels 7 cooperate with a pair of supporting wheels 8 mounted adjacent associated ones of the drive wheels 7 and running on second running surfaces on opposite sides of the guide modules 10 from the first running surfaces. Guide rollers 9, which guide the car 5 in an horizontal plane, are mounted on an upper side of the car in two groups of three wheels each for running on three running surfaces of the guide modules 10.

The car 5 is retained in an encircling support frame 6 and is attached at the upper side adjacent the guide rollers 9 to one end of each of a pair of support elements or cables 19. The cables 19 are guided over a pair of deflecting rollers 14 mounted at opposite ends of the shaft head module 13 and have opposite ends attached to associated ones of a pair of counterweights 18 running within the guide modules 10 as shown in the FIG. 2. A speed limiter 15, which is driven by a limiter cable 20 fastened to the car 5 and guided by a lower deflecting roller 17 fastened on the left-hand side of the foundation module 12, is mounted on the left-hand side of the shaft head module 13. In the case of the elevator car speed exceeding a maximum permissible speed, a not-illustrated car arresting device mounted on the car 5 is triggered in known manner. The guide modules 10 are attached to the building 1 at each of a plurality of floors 3 by respective fastening modules 11 each in the form of a generally U-shaped frame part fastened to the outer surface 2 of the outside wall 16.

Figure 2:
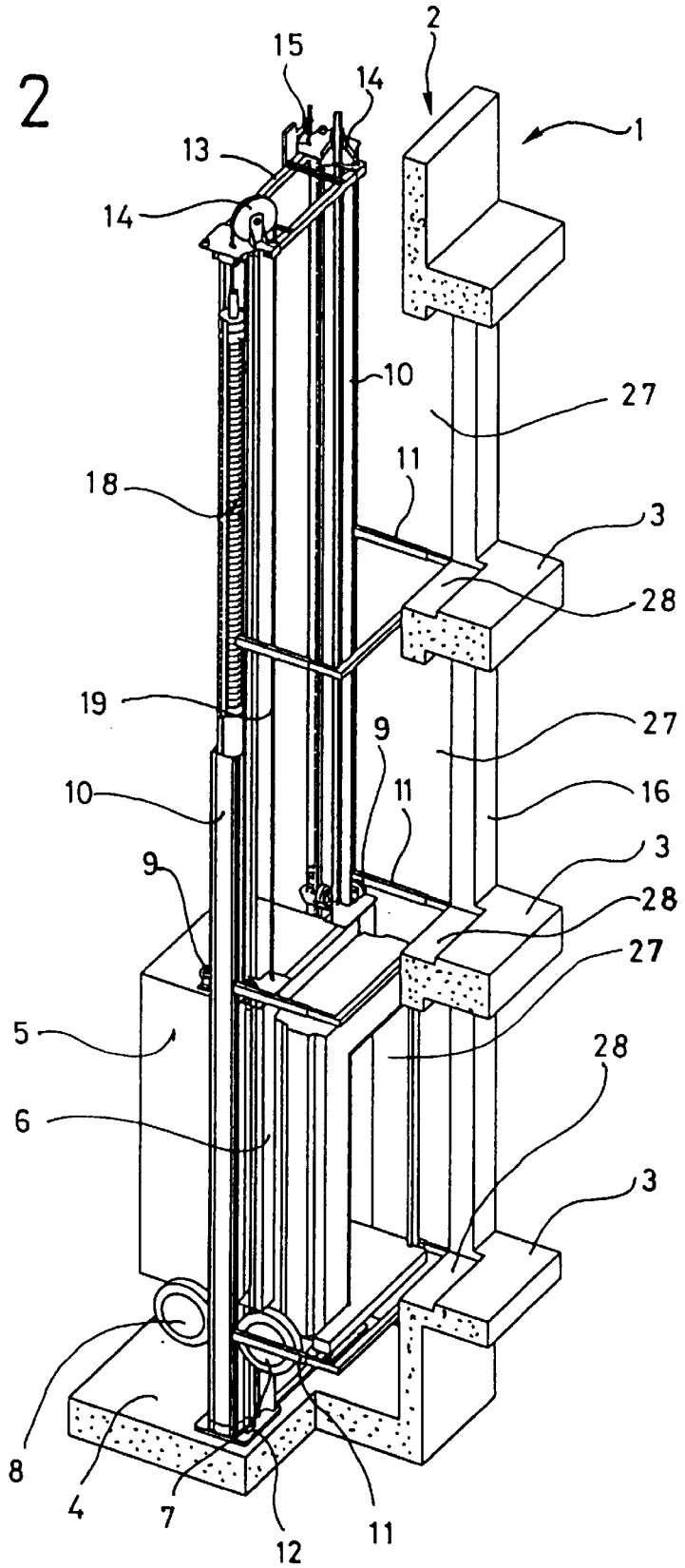
FIG. 2 is a schematic perspective view of the elevator shown in the FIG. 1 viewed from inside the building.

There is shown in the FIG. 2 the building 1 in partial section to illustrate a door opening 27 having a threshold recess 28 at each of the floors 3. The partly cut-open left-hand guide module 10 shows details of the counterweight 18. Each of the counterweights 18 includes a plurality of weight discs are arranged one above the other on a vertically extending rod carrier, the total weight of the discs together with the rod carrier amounting to, for example, half the car weight with a ¼ useful load. The guide modules 10 have substantially a square quadrilateral cross-section. Parts of a shaft position detector, which is not illustrated, are mounted on the car 5 and at the horizontally extending arms of the fastening modules 11 for generating signals representing the position of the car.

Figure 3:
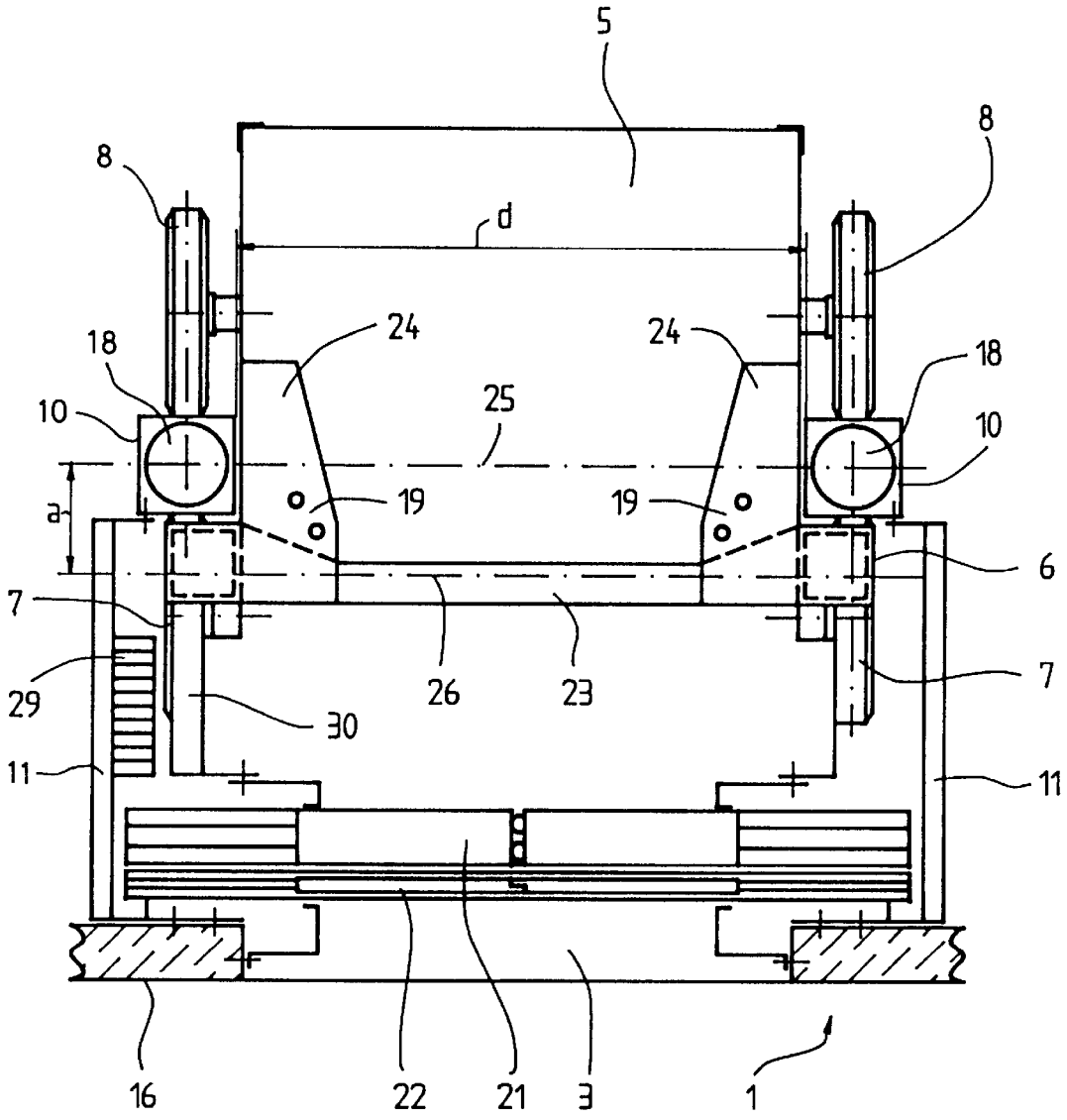
FIG. 3 is a top plan view of the elevator shown in the FIG. 1.

There is shown in the FIG. 3 further parts and subassemblies of the appendable elevator system according to the present invention in plan view and partially in cross-section. The lateral vertical parts of the support frame 6 are connected above the car 5 with a yoke 23, which at each side carries a respective generally L-shaped base plate 24 attached to the yoke. The guide rollers 9, which are not illustrated here, are fastened on the base plates 24. Furthermore, the suspension points for the cables 19 are present on the base plates 24 adjacent to the yoke 23. The building 1 is closed off by a shaft door 22 for each floor 3 and the car 5 is closed off by a car door 21. A distance between the inward sides of the guide modules 10 is denoted by "d" and a guide axis 25 extends parallel with the outside wall 16 of the building 1 and through the longitudinal axes of the guide modules. A constructional plane 26 of the support frame 6 is spaced a distance "a" from the guide axis 25 and extends parallel to oppositely disposed vertical running surfaces of the guide modules 10. The width of the support frame 6 parallel to the guide axis 25 is greater than the distance "d" between the inward sides of the guide modules 10. First elements 29 of a shaft position device are mounted on horizontal connecting stays of the fastening module 11. Second elements 30 of the shaft position device are mounted on the car and are arranged at a small spacing opposite the first elements 29, preferably on the car roof.

The support frame 6 is positioned between the guide modules 10 and the outside wall surface 2 to reduce the overall width of the entire elevator installation and, thus, also the space required on the building base area 4. The not-illustrated drive and command control is arranged in and at the car 5, in particular in or beside the support frame 6, so that no additional space for a machine plant and a control is needed in the building 1. The window openings present at the intermediate floors 3 of a building with a staircase are, for example, suitable for use as the shaft door openings 27. With appropriate adaptation work, the installation of the outside wall shaft doors 22 is possible with acceptable effort at these places, in particular for the reason that these are the only constructional adaptations which are prerequisite for the attachment of such an elevator. The fastening modules 11 are also mounted at the same time as the installation of the shaft doors 22 into the outside wall 16 of the building 1. Then, the building 1 is ready for the attachment of the elevator. The elevator is transported to the building 1 in fabricated form, preliminarily assembled and wired for up to medium conveying heights or up to a height or length permissible for a street transport, is erected there and attached to building 1 by the fastening modules 11. The transport of the ready-made elevator is possible because the guide modules 10 connected together by the foundation module 12 and the shaft head module 13 form a stiff and self-supporting unit which can even be transported together with the car 5 installed. The elevator can, after its installation, be provided with a cladding of any desired kind, for example, with glass, grids or opaque solid wall elements so that a shaft protects the mechanical equipment against climatic influences. By an appropriate architectural structuring of the cladding, the present building character can be taken into account so far that the elevator does not negatively influence the appearance of the building 1, but even provides new architectural accents.

The car 5 is equipped with all mechanical equipment as a prefabricated subassembly and, apart from the complete drive, also includes the necessary control and regulation equipment. Furthermore, the command control for the call processing, the call transmitters, the door control, as well as the illumination and communication means are present. For the floor equipment, prefabricated installation units are provided, which contain the floor call transmitters and display elements. The electrical shaft installation is preferably located as finished installation channel along the fastening modules 11 and fastened thereto. For the power feed and the data exchange, slip lines and opti-electrical systems, for example, are provided, when the use of a suspension cable is not possible or not desirable.

The invention is, however, also applicable to an elevator car without its own drive. In this case, the car can be moved by a cable which extends from the car to the shaft head module 13 and a drive motor mounted there.

The above-described shaft position device elements 29, or its carriers, can also be fastened directly to one of the guide modules 10 and independently of the fastening module 11. As a further variant or augmentation, the mounting of a code strip at the guide module 10 for an optical reader is also permitted.

The fastening modules 11 can be constructed to be horizontally extendible telescopically with attached pre-assembled shaft doors 22 for transport to the building 1, and then can be telescoped from the guide modules 10 at the building site to position the shaft doors 22 at the door openings 27.

As a car-arresting device, a typical wedge or roller arresting device can be used, which engages the guide module 10 at a place especially formed for this purpose.

For the car 5 and the counterweights 18 running in the guide modules 10, appropriate buffer devices, which are not illustrated and are matched to the operational needs, are mounted on the foundation module 12.

The matching to an existing building 1 is not restricted only to cladding. Further attractive effects can be achieved by colored, decorative and constructional variants, in particular at the car 5.

The appendable elevator system according to the present invention can also be erected at any desired interior wall suitable for this, or in the staircase well of a conventional staircase.

In summary, the present invention concerns an appendable elevator for transporting people and goods including a self-supporting and transportable frame having a pair of spaced apart guide modules 10 attached at lower ends thereof to a foundation module 12 and at upper ends thereof to shaft head module 13 and having at least one fastening module 11 attached to the guide modules 10 and adapted to be attached to a surface 2 of a wall 16 of a building 1 with the guide modules 10 extending in a generally vertical direction. The elevator also includes an elevator car 5 mounted for travel along the guide modules 10, a pair of counterweights 18 each mounted for movement in one of the guide modules 10, a pair of cables 19 each having one end attached to the car 5 and an opposite end attached to an associated one of the counterweights 18, a pair of deflecting rollers 14 mounted on the shaft head module 13 and each engaging an associated one of the cables 19 and a shaft door 22 mounted on the fastening module 11 whereby the fastening module 11 extends telescopically from the guide modules 10 for contact with the surface 2 of the wall 16 of the building 1.

The elevator car 5 is retained by a supporting frame 6 and yoke 23 having a constructional plane 26 which extends generally parallel to and is spaced a predetermined distance "a" from a generally horizontally extending guide axis 25 extending through the guide modules 10, the supporting frame 6 and yoke 23 having an horizontal width which is greater than a distance "d" between facing sides of the guide modules 10. A speed limiter cable 20 is attached to the elevator car 5 and engages a lower deflecting roller 17 mounted on the foundation module 12 and a speed limiter 15 mounted on the shaft head module 13. A shaft position device first element 29 is mounted on the fastening module 11 and a shaft position device second element 30 is mounted on the elevator car 5 for cooperation with the first element 29 to generate the car position information.

The elevator car 5 has at least one drive wheel 7 and at least one supporting wheel 8 mounted thereon for engaging opposed surfaces of one of the guide modules 10. The elevator car 5 also has a plurality of guide rollers 9 mounted thereon for engaging surfaces of the guide modules 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An appendable elevator for transporting people and goods comprising:

a self-supporting and transportable frame having a pair of spaced apart guide modules (10) attached at lower ends thereof to a foundation module (12) and attached at upper ends thereof to a shaft head module (13) and having at least one fastening module (11) attached to and telescopically extending from said guide modules (10) and adapted to be attached to a surface (2) of a wall (16) of a building (1) with said guide modules (10) extending in a generally vertical direction;

an elevator car (5) mounted for travel along said guide modules (10);

at least one counterweight (18) mounted for movement in one of said guide modules (10); and at least one cable (19) having one end attached to said car (5) and an opposite end attached to said counterweight (18).

2. The elevator according to claim 1 wherein said elevator car (5) is retained by a supporting frame (6) and yoke (23) having a constructional plane (26) which extends generally parallel to and is spaced a predetermined distance (a) from a generally horizontally extending guide axis (25) extending through said guide modules (10), said supporting frame (6) and yoke (23) having an horizontal width which is greater than a distance (d) between facing sides of said guide modules (10).

3. The elevator according to claim 1 including a deflecting roller (14) engaging said cable (19) mounted on said shaft head module (13).

4. The elevator according to claim 1 including a speed limiter cable (20) attached to said elevator car (5) and engaging a lower deflecting roller (17) mounted on said foundation module (12) and a speed limiter (15) mounted on said shaft head module (13).

5. The elevator according to claim 1 including a shaft position device first element (29) mounted on said fastening module (11) for generating car position information.

6. The elevator according to claim 5 including a shaft position device second element (30) mounted on said elevator car (5) for cooperation with said first element (29) to generate the car position information.

7. The elevator according to claim 1 wherein said elevator car (5) has at least one drive wheel (7) and at least one supporting wheel (8) mounted thereon for engaging opposed surfaces of one of said guide modules (10).

8. The elevator according to claim 1 wherein said elevator car (5) has a plurality of guide rollers (9) mounted thereon for engaging surfaces of said guide modules (10).

9. An appendable elevator for transporting people and goods comprising:

a self-supporting and transportable frame having a pair of spaced apart guide modules (10) attached at lower ends thereof to a foundation module (12) and at upper ends thereof to shaft head module (13) and having at least one fastening module (11) attached to said guide modules (10) and adapted to be attached to a surface (2) of a wall (16) of a building (1) with said guide modules (10) extending in a generally vertical direction;

an elevator car (5) mounted for travel along said guide modules (10);

a pair of counterweights (18) each mounted for movement in one of said guide modules (10);

a pair of cables (19) each having one end attached to said car (5) and an opposite end attached to an associated one of said counterweights (18);

a pair of deflecting rollers (14) mounted on said shaft head module (13) and each engaging an associated one of said cables (19); and a shaft door (22) mounted on said fastening module (11) whereby said fastening module (11) extends telescopically from said guide modules (10) for contact with the surface (2) of the wall (16) of the building (1).

10. The elevator according to claim 9 wherein said elevator car (5) is retained by a supporting frame (6) and yoke (23) having a constructional plane (26) which extends generally parallel to and is spaced a predetermined distance (a) from a generally horizontally extending guide axis (25) extending through said guide modules (10), said supporting frame (6) and yoke (23) having an horizontal width which is greater than a distance (d) between facing sides of said guide modules (10).

11. The elevator according to claim 9 including a speed limiter cable (20) attached to said elevator car (5) and engaging a lower deflecting roller (17) mounted on said foundation module (12) and a speed limiter (15) mounted on said shaft head module (13).

12. The elevator according to claim 9 including a shaft position device first element (29) mounted on said fastening module (11) for generating car position information.

13. The elevator according to claim 12 including a shaft position device second element (30) mounted on said elevator car (5) for cooperation with said first element (29) to generate the car position information.

14. The elevator according to claim 9 wherein said elevator car (5) has at least one drive wheel (7) and at least one supporting wheel (8) mounted thereon for engaging opposed surfaces of one of said guide modules (10).

15. The elevator according to claim 9 wherein said elevator car (5) has a plurality of guide rollers (9) mounted thereon for engaging surfaces of said guide modules (10).

16. An appendable elevator for transporting people and goods comprising:

a self-supporting and transportable frame having a pair of spaced apart guide modules (10) attached at lower ends thereof to a foundation module (12) and attached at upper ends thereof to a shaft head module (13) and having at least one fastening module (11) attached to said guide modules (10) and adapted to be attached to a surface (2) of a wall (16) of a building (1) with said guide modules (10) extending in a generally vertical direction;

an elevator car (5) mounted for travel along said guide modules (10);

at least one counterweight (18) mounted for movement in one of said guide modules (10);

at least one cable (19) having one end attached to said car (5) and an opposite end attached to said counterweight (18); and a shaft door (22) mounted on said fastening module (11).

* * * * *